US008561620B2

(12) United States Patent
Morgandi et al.

(10) Patent No.: US 8,561,620 B2
(45) Date of Patent: Oct. 22, 2013

(54) HAIRSTYLING APPARATUS

(75) Inventors: Arturo Morgandi, Azzano S. Paolo BG (IT); Alberto Aguti, Azzano S. Paolo BG (IT); Claudio Mosconi, Azzano S. Paolo BG (IT); Monica Wilhelm, Azzano S. Paolo BG (IT)

(73) Assignee: Tenacta Group S.p.A., Azzano S. Paolo BG (IT)

( * ) Notice: Subject to any disclaimer, the term of this patent is extended or adjusted under 35 U.S.C. 154(b) by 49 days.

(21) Appl. No.: 12/809,068

(22) PCT Filed: Dec. 19, 2007

(86) PCT No.: PCT/IT2007/000889

§ 371 (c)(1),
(2), (4) Date: Jun. 17, 2010

(87) PCT Pub. No.: WO2009/078046

PCT Pub. Date: Jun. 25, 2009

(65) Prior Publication Data

US 2010/0269848 A1 Oct. 28, 2010

(51) Int. Cl.

| | |
|---|---|
| ***A45D 1/00*** | (2006.01) |
| ***A45D 1/04*** | (2006.01) |
| ***A45D 24/16*** | (2006.01) |
| ***A45D 4/16*** | (2006.01) |

(52) U.S. Cl.
USPC ..... 132/224; 132/108; 132/234; 219/225

(58) Field of Classification Search
USPC ..... 132/108–110, 207, 233, 234, 221, 132/223–232, 269, 271, 272; 219/225
See application file for complete search history.

(56) References Cited

U.S. PATENT DOCUMENTS

| | | | | |
|---|---|---|---|---|
| 2,660,182 | A * | 11/1953 | Kaul | 132/109 |
| 2,776,667 | A * | 1/1957 | Fitz Gerald | 132/224 |
| 4,597,191 | A | 7/1986 | Juzefczyk | |
| 5,761,824 | A | 6/1998 | Moon et al. | |
| 5,848,599 | A * | 12/1998 | Todd | 132/221 |
| 5,913,315 | A | 6/1999 | Todd | |
| 6,736,692 | B1 * | 5/2004 | Hoyos-Zermeno et al. | 446/296 |
| 2004/0000319 | A1 * | 1/2004 | Carballada et al. | 132/224 |

(Continued)

FOREIGN PATENT DOCUMENTS

| | | |
|---|---|---|
| EP | 1623648 A1 | 2/2006 |
| EP | 1652445 A1 | 5/2006 |

(Continued)

OTHER PUBLICATIONS

PRIMO Purely Plastics, Polyesters (Thermoplastic) PETP, PBT, PET semi-crystalline.*

*Primary Examiner* — Nicholas Lucchesi
*Assistant Examiner* — Niyati D Shah
(74) *Attorney, Agent, or Firm* — Husch Blackwell LLP

(57) ABSTRACT

The invention refers to a hairstyling apparatus (11) comprising: a first arm (12); a second arm (14), connected to said first arm (12) so as to allow the apparatus to be opened and closed by moving said arms, respectively, apart and close, one to the other,—at least one first heatable element (15) positioned on said first arm and at least one second heatable element (35*b*) positioned on said second arm, whereby the apparatus also comprises one or more seats (19) suitable for housing therein at least one treatment device (20) suitable for releasing a hair substance in operative conditions.

24 Claims, 7 Drawing Sheets

(56) References Cited

U.S. PATENT DOCUMENTS

| | | | | |
|---|---|---|---|---|
| 2004/0163661 | A1* | 8/2004 | Carlucci | 132/222 |
| 2006/0037625 | A1 | 2/2006 | Kayser et al. | |
| 2006/0108344 | A1* | 5/2006 | Kim et al. | 219/225 |

FOREIGN PATENT DOCUMENTS

| | | | |
|---|---|---|---|
| WO | WO 2005023046 | A1 * | 3/2005 |
| WO | 2005087039 | A1 | 9/2005 |
| WO | 2006023802 | A2 | 3/2006 |

* cited by examiner

HAIRSTYLING APPARATUS

CROSS REFERENCE TO RELATED APPLICATIONS

This application is a U.S. National Phase Application of International Application No. PCT/IT2007/000889 filed on Dec. 19, 2007. The disclosure of International Application PCT/IT2007/000889 is incorporated herein by reference.

The present invention refers to a hairstyling apparatus comprising at least one seat suitable for housing inside therein at least one treatment device suitable for releasing a hair substance in operative conditions.

In particular, the apparatus of the invention has a preferred application, although not exclusive, in electric hair straighteners.

Nowadays, increasingly frequent use is made, both in professional salons and at home, of cosmetic substances which are applied to the hair, for example for caring the hair itself, for its strengthening or for improving its appearance. The application of such hair substances is however not very practical since it requires a certain period of time to perform all of the necessary operations, such as, for example, preparing the accessories for such an application, applying the hair substance, leaving it to work for the time needed to allow the active ingredients contained in such hair substances to perform their function on the hair, and rinsing.

Recently, it has been observed that it is advantageous to apply such hair substances during the normal hair drying operations. In fact, various kinds of devices have been proposed, being incorporated in hairdryers or in accessories applicable to hairdryers, which release hair treatment agents upon the action of the hot air that flows from the hairdryer towards the hair itself.

In fact, for example, U.S. Pat. No. 4,597,191 describes a method for transferring a treatment agent onto the hair upon the passage of hot air through a support material containing such a treatment agent, said support material being positioned at the air outlet of a hairdryer. The supports described in such a patent are made from paper or unwoven fabric, such as, for example, unwoven rayon. Similarly, U.S. Pat. No. 5,761,824 describes an accessory arranged in the outlet mouth of a hairdryer comprising a fibrous spongy support material, such as fabric or cotton, containing a hair treatment agent. The International patent application WO 2005/087039 describes an accessory for hair treatment that rotates when exposed to the hot air flow of the hairdryer to which it is applied. Such an accessory is made from absorbent or semi-absorbent support material, such as polyester, cotton, wood or others and contains a hair treatment agent.

Nevertheless, such solutions cannot be applied to other electrical hair treatment apparatuses, such as, for example, to the straighteners for hair ironing or straightening or to the curlers, due to the fact that they have shape and method of use that are completely different from the hairdryers.

Generally, hair straighteners consist of a first and a second arm, connected together by means of a hinge that allows said arms to be opened and closed, and of heatable elements positioned on said arms. When one wishes to subject a hair tuft to a styling action, such arms are opened to allow the hair tuft to be inserted between the two arms and, thereafter, they are closed to hold such a tuft between them. In such a position, the hair tuft is subjected to the heat emitted by said heatable elements, for the time necessary before being released upon the opening of the arms.

Examples of apparatuses for hair straightening are described, for example, in the patent application EP 1623648, in the American patent application published as US 2006-0037625, and in the international patent application WO 2006-23802. In particular, the latter application discloses a hair straightening apparatus wherein at least a portion of one of the arms is coated with a material that allows a user to keep a firm grip on said apparatus with both hands for a better use. Such a material is also able to allow hot application of hair products for a better absorption.

However, there still remains the need to provide a hairstyling apparatus that can easily house a treatment device for releasing a cosmetic substance to be applied to the hair at the desired moment.

The technical problem forming the basis of the present invention is to allow a user of an apparatus suitable for hair styling to also use a treatment device suitable for releasing a hair cosmetic substance in operative conditions, during such a hair styling action, in a simple, automatic and functional way, the use of said treatment device not causing hindrances to the use of said apparatus, and vice-versa.

According to the invention, this problem is solved by an apparatus as defined in the attached claim 1.

According to the invention, it has indeed been found that a hairstyling apparatus comprising:

- a first arm;
- a second arm, connected to said first arm so as to allow the apparatus to be opened and closed by moving said arms, respectively, apart and close, one to the other;
- at least one first heatable element positioned on said first arm and at least one second heatable element positioned on said second arm, characterised in that said apparatus also comprises one or more seats suitable for housing therein at least one treatment device suitable for releasing in operative conditions a hair substance, allows a user of said apparatus to easily insert into said one or more seats a treatment device that, at the desired moment, is able to automatically release a hair substance to be applied to a to be styled hair tuft held between said first and second heatable elements, when said arms are in the closed position.

Examples of said apparatuses are straighteners or curlers, preferably electrical, used intensely to style hair, both in professional salons and at home. Examples of hair styling actions are, for example, hair straightening or curling. Preferably, said apparatus is an electric hair straightener.

In the present description and in the subsequent claims, by the term "in rest conditions" it is meant the situation in which the apparatus is kept generally at room temperature. A typical situation of the rest condition is when the apparatus is not activated.

Vice-versa, by the term "in operative conditions", it is meant the situation in which elements contained in the apparatus suitable for generating and transmitting heat so as to promote the hair styling actions are activated.

Another advantage of the present invention is that the hair substance is released by said treatment device without having to interrupt the hair styling operations, so that, whilst the user of the apparatus styles the hair, said hair substance forms a protective layer on the hair itself, protecting it from heat and humidity, and at the same time making it shine, consequently making easier the hair styling itself and having a longer-lasting result.

Moreover, the fact that the hair substance has been heated up to a certain temperature at the moment in which it comes into contact with the to be styled hair tuft gives the advantage of making easier the hair styling itself and to obtain better aesthetic results.

Preferably, said apparatus also comprises a first heating element, suitable for heating said first heatable element in operative conditions. Moreover, preferably, said apparatus also comprises a second heating element, suitable for heating said second heatable element in operative conditions.

In this way, each of said first and second heatable elements is heated by a heating element associated to them.

Preferably, said first heating element is positioned in a space formed between said first arm and said first heatable element. Similarly, said second heating element is positioned in a space formed between said second arm and said second heatable element.

In this way, the available space is exploited, reducing the bulk of the hairstyling apparatus.

Preferably, according to a first aspect of the invention, at least one of said seats is formed in at least one of said first and/or second heatable elements, in any position, such as, for example, in a central position, at one or more edges, or in an intermediate position between said positions.

In this way, at least one of said first and/or second heating elements also heats in operative conditions said at least one of said seats, the latter being an integral part of said heatable element. Consequently, there is the advantage that at least one of said first and/or second heating elements also heats the treatment device when it is housed in said at least one of said seats and therefore also the hair substance contained in said treatment device. The cosmetic ingredients contained in said hair substance are thus heat activated, making it easier their releasing from the treatment device and their application onto the hair tuft held between said arms in closed position.

Hereafter some preferred embodiments of said first aspect of the invention are illustrated.

In a first embodiment, the apparatus of the present invention comprises at least one of said seats positioned at an edge of at least one of said heatable elements.

In this way, there is the advantage of allowing the user to easier handle said treatment device during the steps of its insertion into said seat, and its subsequently removal.

In a second embodiment, the apparatus of the present invention comprises at least two of said seats positioned at opposite edges of at least one of said heatable elements.

In this way, as well as having good advantages from the point of view of easy handling, there is also the advantage to have at least two seats for housing at least two treatment devices, which can be used, for example, so as to allow a greater amount of hair substance to be applied during the same hair styling operation.

In a third embodiment, the apparatus of the present invention comprises at least one of said seats positioned at an edge of said first heatable element and at least another of said seats is positioned at an edge of said second heatable element.

In this way, there is the advantage of having an apparatus that uses an edge of both said first and second heatable elements as a seat for housing said treatment devices. This embodiment can be useful in the case in which it is desired to have, for example, one treatment device containing a certain hair substance housed at an edge of the first heatable element and another treatment device containing another hair substance housed at an edge of the second heatable element. In this way, the two hair substances can be released at different times according to the temperatures to which the two different treatment devices containing them are heated.

In a fourth embodiment, the apparatus of the present invention comprises at least two of said seats positioned at opposite edges of said first heatable element and at least another two of said seats positioned at opposite edges of said second heatable element.

An advantage of this embodiment can be obtained, for example, in the case in which it is desired, for each of said two seats positioned at opposite edges of said first heatable element, to contain treatment devices to release a greater amount of a first hair substance and, for each of said two seats positioned at opposite edges of said second heatable element, to contain treatment devices to release a greater amount of a second hair substance.

Preferably, said edges of said heatable elements according to the embodiments described above are arranged outside of said arms.

In this way, there is the advantage of being simple to make and easily accessible for the user.

In a fifth embodiment, the apparatus of the present invention comprises at least one of said seats which is centrally positioned with respect to at least one of said heatable elements.

An advantage of this embodiment consists of greater practicality for the user who arranges the hair to be styled between the two arms in closed position, knowing that the portion of hair tuft that will be reached by the hair substance is the one arranged at the centre of the apparatus, at said seat.

In a sixth embodiment, the apparatus of the present invention comprises at least one of said seats which is centrally positioned with respect to said first heatable element and at least another of said seats which is centrally positioned with respect to said second heatable element. Preferably, according to any one of the embodiments described above, said apparatus comprises at least one further heating element arranged at each of said seats.

In this way, the heat emitted by said further heating element quickly reaches said seat, reducing the heat dispersion and keeping the seat and, therefore, the treatment device at a temperature independent from that of the heatable element.

Preferably, as an alternative to the embodiments described above, in accordance with a second aspect of the invention, at least one of said seats is formed in at least one further heatable element, said further heatable element being positioned on at least one of said arms and being separate from said first heatable element and from said second heatable element.

For example, in accordance with a seventh embodiment of the present invention, one of said seats and said first heatable element are both positioned on said first arm; however, said seat and said first heatable element are two distinct elements, separate from one another. Therefore, the heating element, which in operative conditions heats said first heatable element, is unable to also suitably heat said seat. In a totally similar way to what has been described above, said seat can be positioned on said second arm.

In accordance with said second aspect of the invention, said apparatus comprises at least one further heating element, positioned near to said further heatable element and therefore suitable for heating it, in operative conditions.

In this way, the heat emitted by said further heating element quickly reaches said seat, formed in said further heatable element, reducing the heat dispersion and keeping said seat, and therefore the treatment device contained in it, at the desired temperature.

Preferably, said at least one further heatable element is arranged at least one edge of said first heatable element and/or of said second heatable element.

In accordance with an eighth preferred embodiment of the present invention, two of said seats are formed in two further heatable elements positioned on said first arm, at opposite edges of said first heatable element, but separate from them. Similarly, said seats can be positioned on said second arm.

Similarly to what has been described above with reference to the seventh embodiment of the invention, also in this eighth embodiment, said apparatus comprises at least one further heating element for each of said seats, positioned near to said further heatable element and therefore suitable for heating it, in operative conditions.

Preferably, the seats described above according to any one of the different embodiments are parallelepiped shaped or cylindrical shaped with elliptical or circular section. In this way, said seats are suitable for housing treatment devices having typically said shapes. Preferably, the shape of said seats is parallelepiped, with square, rectangular or trapezoidal section.

Preferably, the apparatus of the present invention also comprises closing devices suitable for covering those seats that are suitable for housing said treatment devices for releasing hair substances but that, in operative conditions, are empty, i.e. those seats that do not house any of said treatment devices.

In this way, it is avoided that any hair tuft can be damaged by the contact with sharp profiles of said seats free of treatment devices.

Moreover, in the case in which all of the seats suitable for housing said treatment devices are free of said treatment devices, said seats are covered with said closing devices and the apparatus of the present invention can be used as a normal apparatus, without any hair substance being released during the hair styling operations.

Preferably, the apparatus of the present invention comprises at least one control device for adjusting the temperature of said heatable elements. More preferably, the apparatus of the present invention comprises at least one first control device for adjusting the temperature of said first heatable element and at least one second control device, distinct from the first control device, to adjust the temperature of said second heatable element.

The fact that there are distinct control devices for each heatable element is particularly advantageous in those embodiments in which, for example, said first and second heatable elements have a different number of seats to house said treatment devices. Such a difference implies a different shape of the heatable elements and therefore a different body mass, increased by the presence of a different number of treatment devices and, consequently, by a different heat dispersion. Therefore, it is particularly advantageous to be able to adjust the temperatures of said heatable elements by different control devices.

Preferably, the apparatus of the present invention comprises at least one further control device for adjusting the temperature of said at least one further heatable element.

In this way, the temperature of said further element heating said seat, near to which it is positioned, can be adjusted autonomously, independently from the temperature of said first and second heating elements. Therefore, the treatment device can be heated to a certain temperature T1 by said further heating element, to allow the treatment device itself to release the hair substance, whilst the hair tuft, held between said first and second heatable elements, can be heated by them to a temperature T2 different to T1.

Preferably, each of said control devices has its own electronic on/off switch, for example, of the SCR ("Silicon Controlled Rectifier") diode type or of the TRIAC ("Triode Alternate Current") type, and its own temperature detection sensor, for example, of the NTC ("Negative Temperature Coefficient") type.

In this way, each of said switch/sensor of a control device acts independently from the switch/sensor of other control devices (also based, for example, upon the type of hair substance that has to be released by the different treatment devices housed in said seats).

Preferably, the apparatus of the present invention also comprises a presser suitable for making contact with the treatment device. Said presser can, for example, be a roller or a pad.

In this way there is the advantage of exerting a mechanical pressure onto said treatment device to make it easier said hair substance contained therein to be released. Moreover, said mechanical action also allows a hair adhesion increase against said treatment device, so as to improve said hair substance diffusion onto the hair itself.

Preferably, said presser is equipped with springs or elastic means so as to allow said presser to be pushed towards said treatment device. More preferably, said springs or elastic means are adjustable through a device for adjusting the thrusting force so as to be able to vary the force with which said presser is pushed towards said treatment device, so that the treatment device itself releases the desired amount of hair substance, according to requirements.

Said treatment device, used in the apparatus of the present invention, comprises a support material soaked with said hair substance.

Preferably, said support material can be an expanded or sintered plastic material, sintered metallic material or cellulose derivate, polymeric derivate from polyacrylics and from polyesters, from terephthalates, from polyethylenes, silicon and derivates, fabrics, unwoven fabrics, or mixtures thereof.

More preferably, said support material is polytetrafluoroethylene (PTFE) or a bicomponent fibre of polyolefin.

Preferably, said treatment device comprises a support material in bicomponent fibre of polyolefin; more preferably in bicomponent fibre of polyester terephthalate (PET) and of polybutylene terephthalate (PBT). Preferably, said treatment device comprises a support material in fibre of PET and of PBT, wherein the amounts of PET and of PBT are, respectively, within the range 20%-80% and 80-20%, in molar percentage with respect to the total number of moles of the bicomponent fibre. More preferably, the amounts of PET and of PBT are, respectively, within the range 30%-70% and 70-30% in molar percentage with respect to the total number of moles of the bicomponent fibre.

Said support material is able to have a high absorption factor of hair substance, for example from about 1 gram to about 50 grams, preferably from about 1 to about 20 grams, and to hold inside it, in rest conditions, said hair substance for long time periods, for example at least one year, without deteriorating and keeping its structure and consistency. In this way, leaks of the hair substance from the treatment device are advantageously prevented, thus avoiding the wastage and the dripping of the hair substance itself.

Said treatment device has the advantage of being made from material such as to be able to be easily styled into the desired solid shape, which is kept unchanged both when the treatment device is in rest conditions, and in operative conditions.

Preferably, the support material of said treatment device comprises some cavities on its outer surface; said cavities allow the support material to be able to better hold said hair substance in rest conditions. More preferably, the support material also comprises some cavities at its inside, connected to said cavities on the outer surface; in this way, the support material is such that the treatment device, in rest conditions, is more soaked with the hair substance, for example up to 15 ml.

Advantageously, said treatment device is also such as to release, in operative conditions, in the average hair styling times, substantially all of the hair substance that was held therein in rest conditions. In this way, there is the advantage of avoiding that part of said hair substance still remains incorporated and held in the treatment device itself.

Moreover, said treatment device is made from a material that has a melting point that varies within the range from about 215° C. to about 275° C. Said treatment device is therefore such as to withstand the heat when inserted in the apparatus of the present invention, typically between about 140° C. and about 200° C., and subjected to the operative steps for hair treatment, without at the same time emitting harmful or toxic substances.

Advantageously, the shape of the treatment device is such as to occupy said seats. Preferably, said treatment device is solid and parallelepiped shaped with square, rectangular or trapezoidal section, or cylindrical shaped with circular section, circular section perforated in the centre or elliptical section. Said shape allows the treatment device itself to be easily inserted into the suitable seats present in the apparatus of the present invention, before the operative hair styling steps start, and to be equally easily removed when necessary.

Such a treatment device has a surface, suitable for being placed in contact with the hair tuft to be styled, of a such size to release the suitable amount of hair substance to style said hair tuft.

Moreover, said treatment device has a volume suitable for containing a total amount of hair substance to be released to style in succession a plurality of hair tufts, preferably all of the hair tufts to be styled.

Advantageously, said seats for housing said treatment device are provided with parallel guides to make it easier to insert said treatment device therein. Preferably, said seats are also provided with means for locking the treatment device inside the seat itself, so as to keep it in a still and stable position in operative conditions.

In a particular embodiment, said treatment device can be inserted in at least one of said seats through a drawer or similar housing fixed to said seat, said drawer having a shape compatible with said treatment device and with said seat.

In this way a greater stability of the treatment device is obtained and the relative insertion and removal operations by the user are made easier.

Preferably, the apparatus of the present invention also comprises an instrument for combing hair in operative conditions, such as for example a comb or a brush, positioned at one of said treatment devices.

Said treatment device is produced through conventional production processes, such as, for example, an extrusion or mould forming process suitable for creating a cauterisation of the outer parts to prevent the weakening and therefore, over time, the scaling of the outer surfaces.

Preferably, said hair substance comprises cosmetic agents, such as, for example, conditioning and antistatic agents, hydrating active substances, thermoactive substances, emulsifiers, solubilisers, stabilisers, cosmetic elements, such as, for example, polymers, proteins, silk proteins, vitamin C, vitamin E, panthenol (vitamin B5), vitamin B6, vitamin PP, amino acids, keratin, vegetable extracts, silicon oils, such as, for example, cyclomethicone, dimethiconol, dimethicone, phenyltrimethicone, essential oils, and other substances intended for the hair health. Said cosmetic elements are preferably mixed with aqueous, oily or mixed oil/aqueous solvent.

Said hair substances have the special feature of protecting the structure and damaged hair surfaces, are activated by the heat emitted by the apparatus and form a protective coating that sticks to the hair surface.

Advantageously, said treatment device is placed in special packages suitable for conserving and maintaining the stability over time of the hair substance contained in said treatment device, such as, for example, air-tight packages or sealed packages with modified atmosphere or under vacuum. The treatment device is then removed from the package just at the moment of its use and inserted directly, into the special seats present in the apparatus. Therefore, no further action has to be made by the user, such as, for example, component mixing and their dosing to obtain the hair substance in the composition suitable for beginning styling.

Preferably, said treatment device is present in single-use packages or disposable packages, in the sense that each treatment device contains the proper hair substance amount suitable for a single hair styling operation.

In this way, the treatment device in single-use packages avoids the user having the problem to repeatedly check, in operative conditions, the amount of hair substance used up to that time, since all of said amount is such as to be used during the average time period of an entire styling operation.

At the end of each individual hair styling operation, for example at the end of a hair straightening step, the treatment device, substantially without the hair substance that has been released, is removed from the special seat present in the apparatus so as to leave the seat itself free, so as to be able to insert a new treatment device before beginning a new hair styling operation.

Further characteristics and advantages of the apparatus of the present invention shall become clearer from the following detailed description of some of its preferred embodiments, made as a non-limiting example only with reference to the attached drawings. In such drawings, FIG. 1 is a perspective view of a prior art electric hair straightener;

Figure 4A:
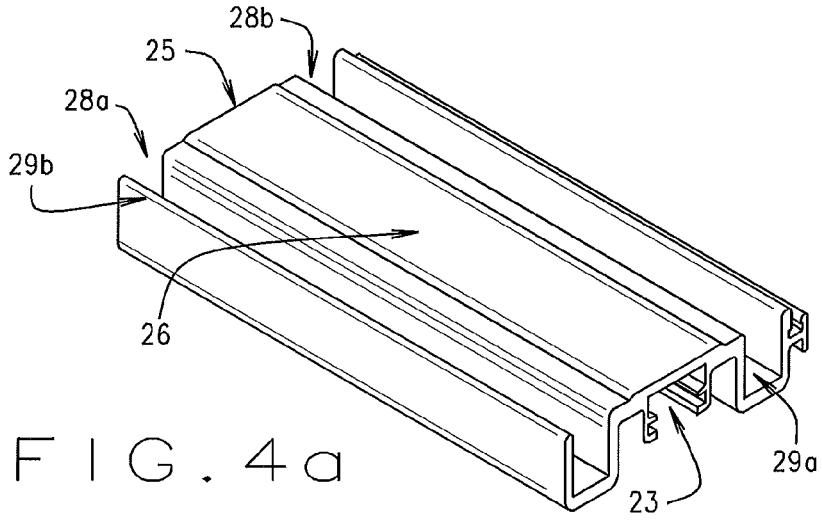
Figure 4B:
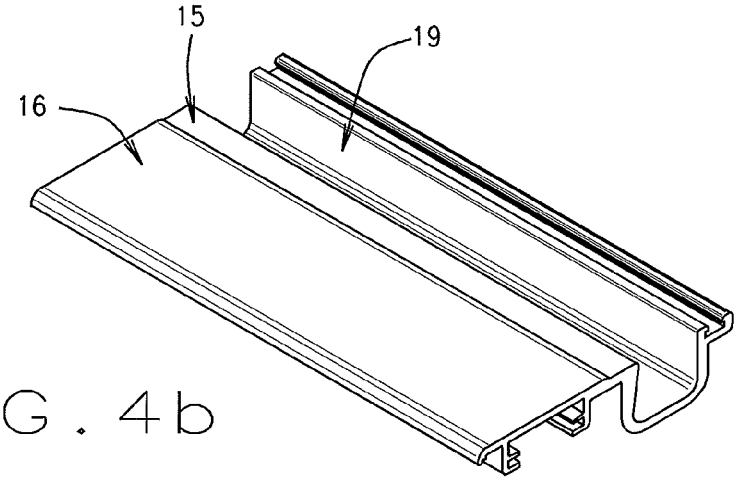
Figure 5:
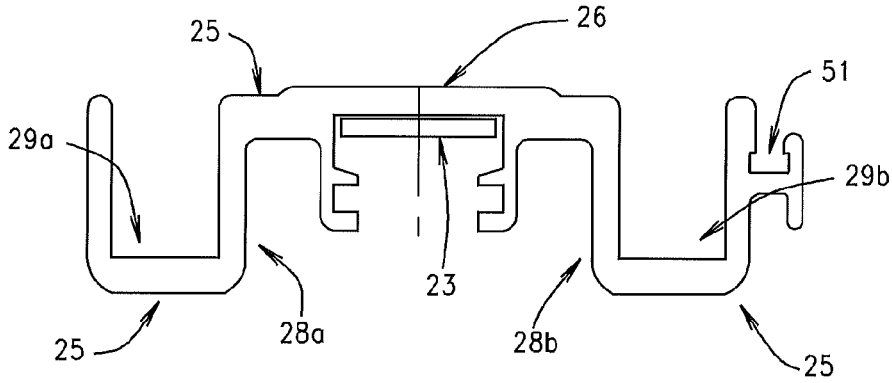

FIG. 4*a* is a perspective view of a detail (a heatable element) of the second preferred embodiment of the hair apparatus, in accordance with the present invention;

FIG. 4*b* is a perspective view of a detail (a heatable element) of the first preferred embodiment of the hair apparatus, in accordance with the present invention;

FIG. 5 is a side view of the detail shown in FIG. 4*a;*

Figure 6:
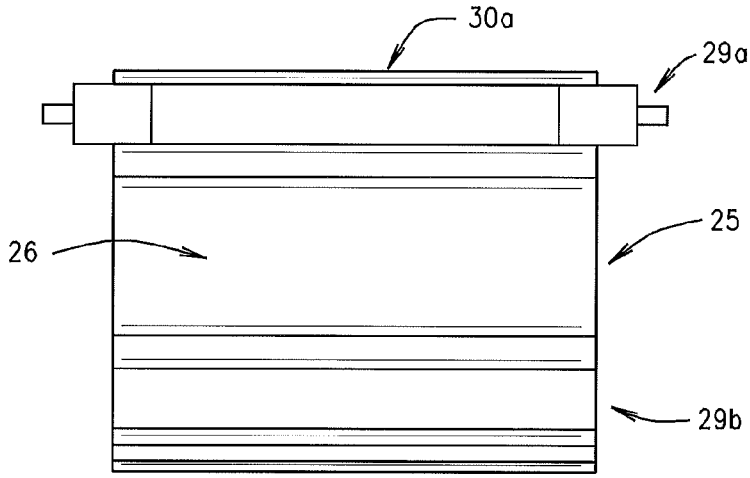
Figure 6:
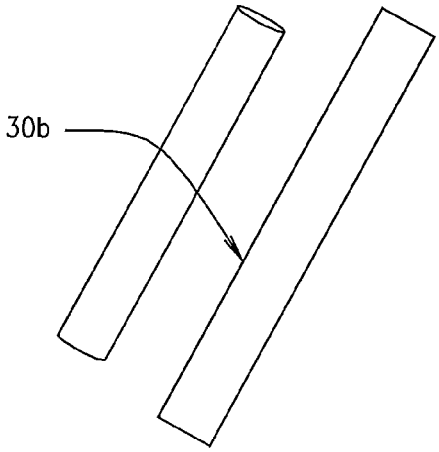
Figure 7:
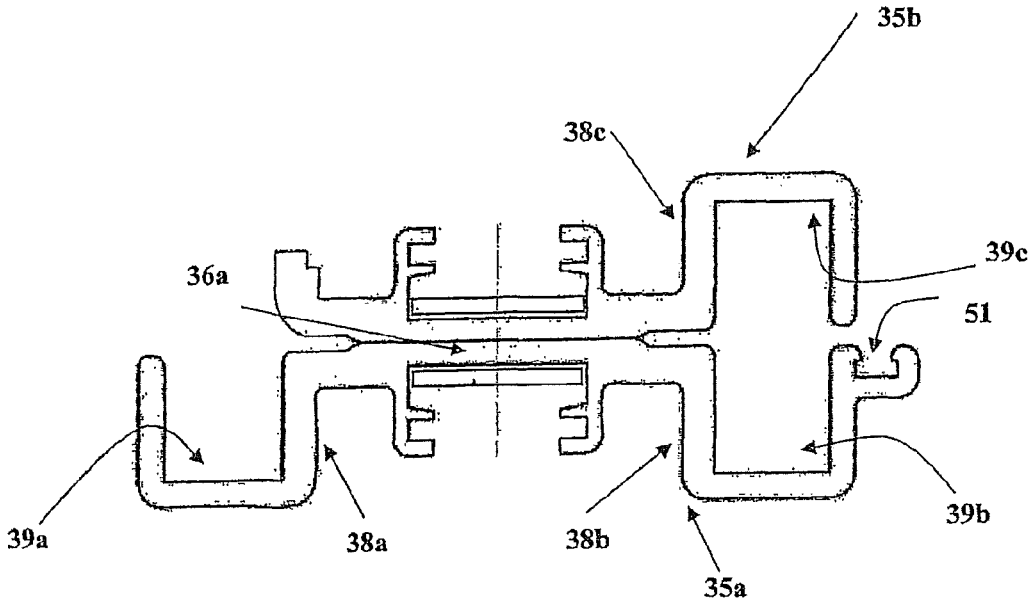
Figure 8:
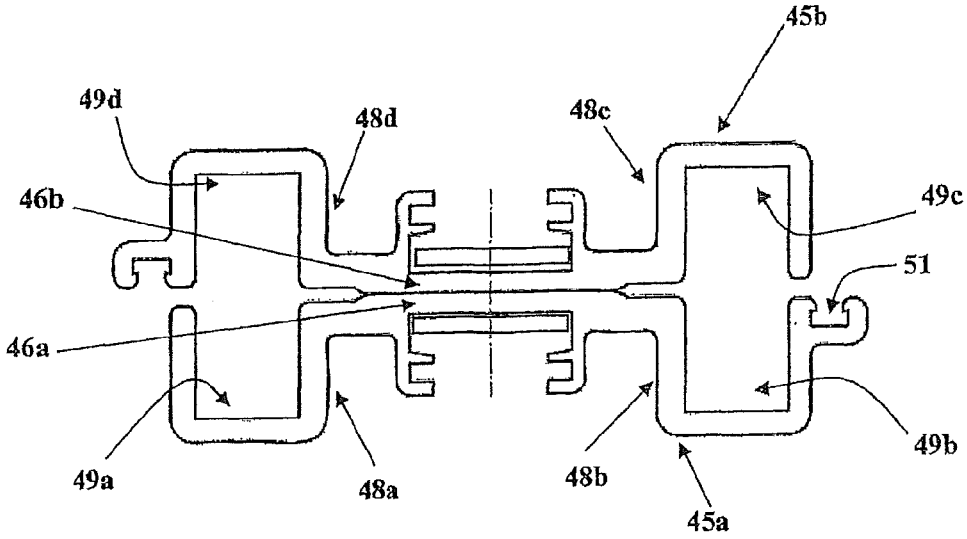
Figure 9:
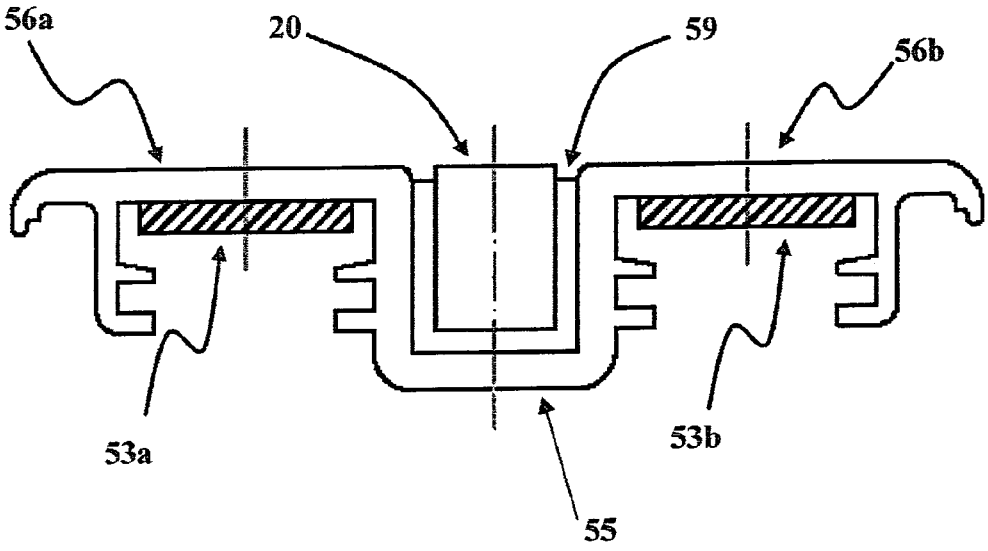
Figure 10:
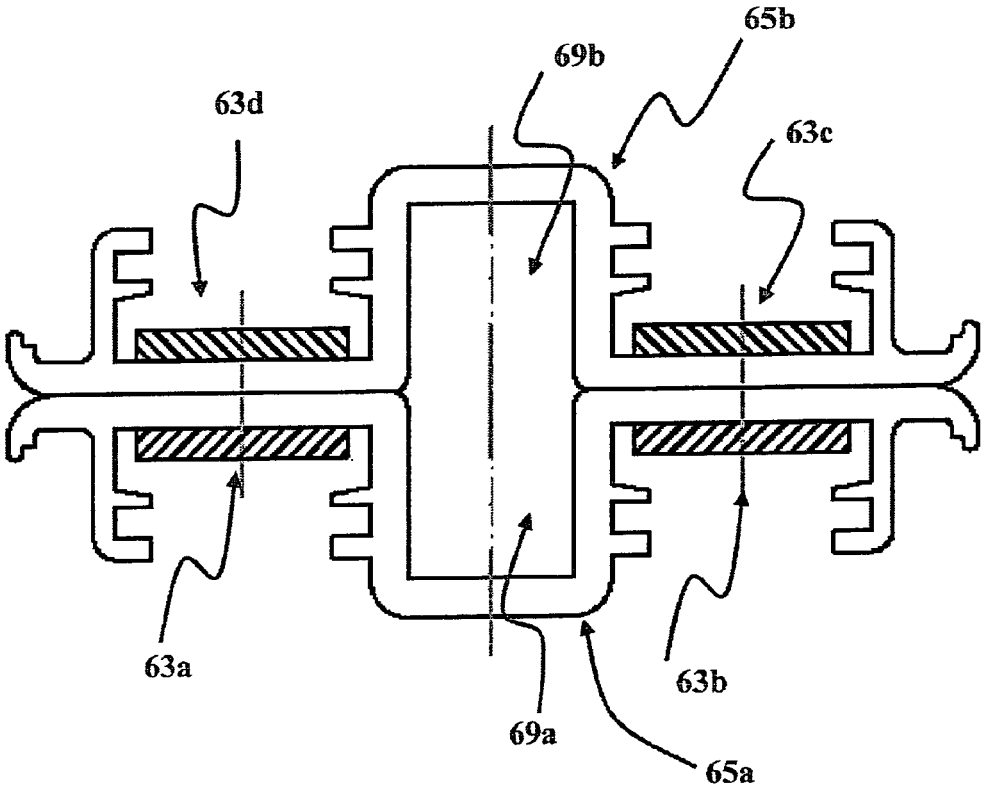
Figure 11:
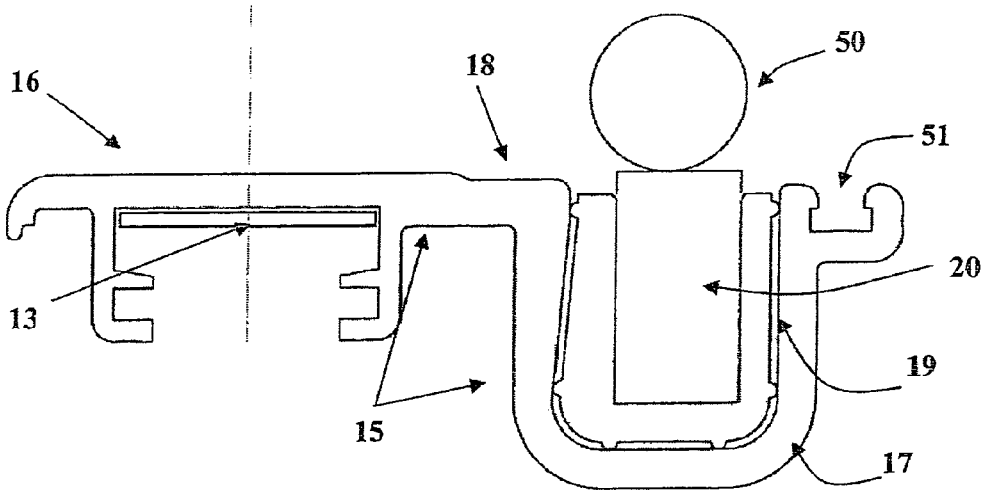
Figure 12:
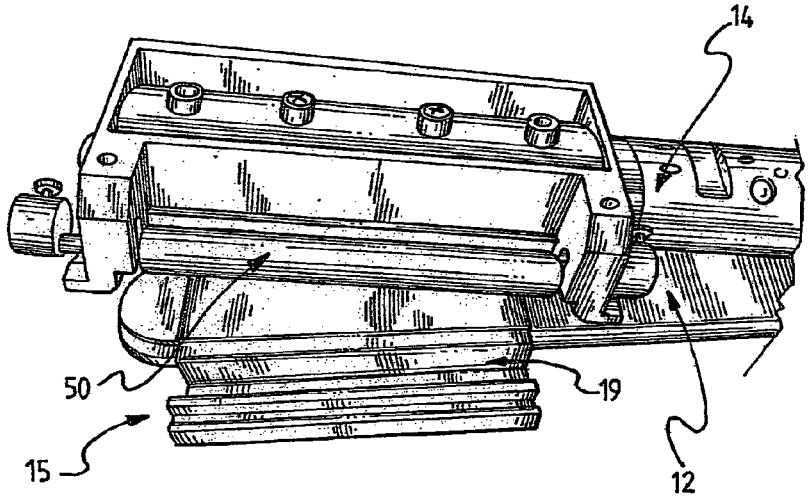
Figure 13:
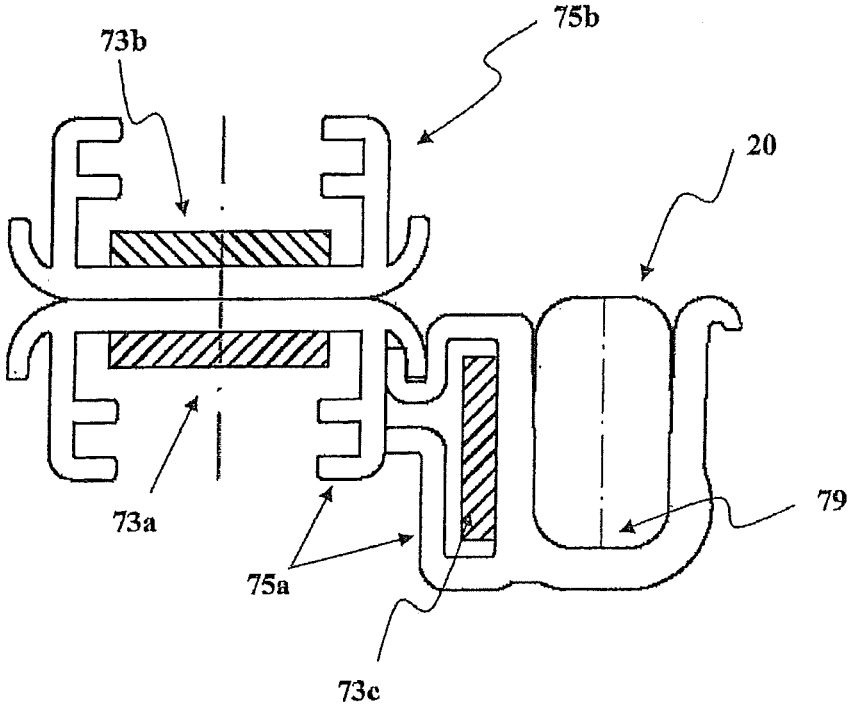
Figure 14:
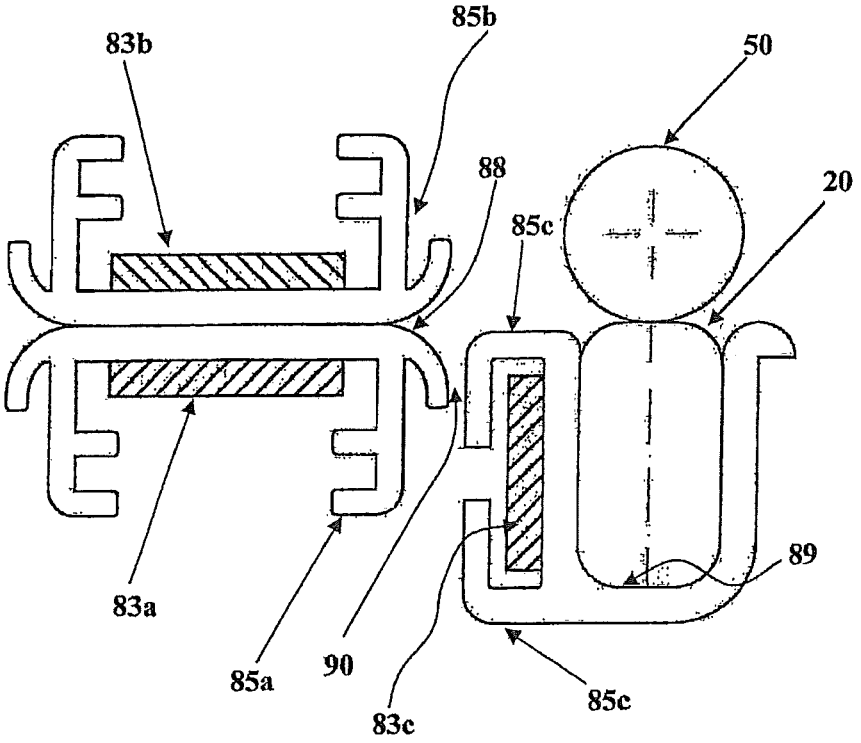

FIG. 6 is a top view of the heatable element shown in FIG. 4*a* and of the treatment devices suitable for being housed in said heatable element;

FIG. 7 is a side view of two heatable elements, each applied to an arm of a hair apparatus, in accordance with a third embodiment of the present invention, said arms being in closed position;

FIG. 8 is a side view of two heatable elements, each applied to an arm of a hair apparatus, in accordance with a fourth embodiment of the present invention, said arms being in closed position;

FIG. 9 is a side view of a heatable element, in accordance with a fifth preferred embodiment of a hair apparatus, in accordance with the present invention;

FIG. 10 is a side view of two heatable elements, each applied to an arm of a hair apparatus, in accordance with a sixth preferred embodiment of a hair apparatus, in accordance with the present invention;

FIG. 11 is a side view of a further preferred embodiment of a hair apparatus in accordance with the present invention, comprising a presser;

FIG. 12 is a perspective view of the apparatus shown in FIG. 11;

FIG. 13 is a side view of a heatable element, in accordance with a further preferred embodiment of a hair apparatus, in accordance with the present invention, comprising a further heating element near to a seat;

FIG. 14 is a side view in accordance with a seventh preferred embodiment of a hair apparatus in accordance with the present invention.

Figure 1:
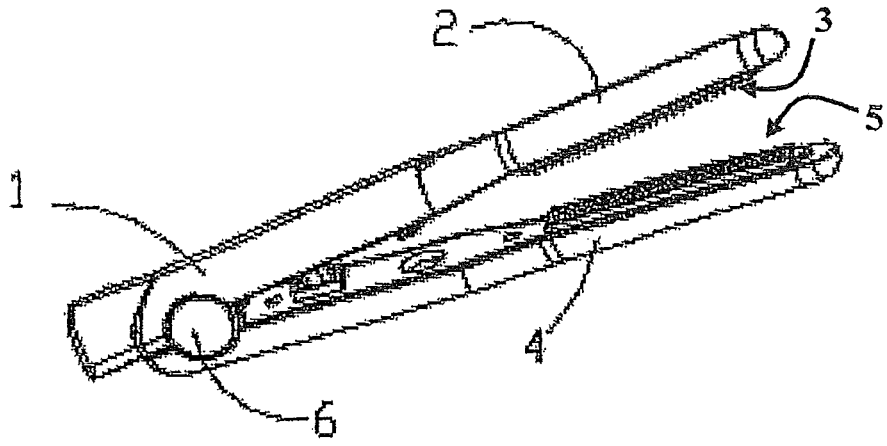
PRIOR ART FIG. 1

With reference to FIG. 1, a prior art electric hair straightener is indicated with 1, wherein it is shown a hinge 6 that connects the two arms 2,4 on which the two heatable elements 3,5 suitable for hair styling when held between said arms 2,4, in closed position are respectively applied.

Figure 2:
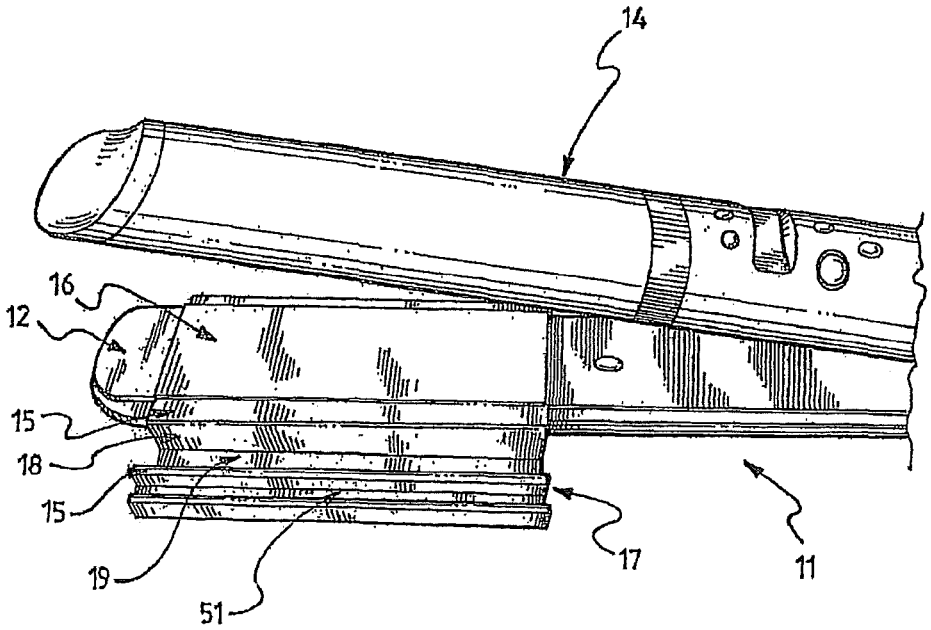
FIG. 2 is a perspective view of a first preferred embodiment of a hair apparatus in accordance with the present invention.
Figure 3:
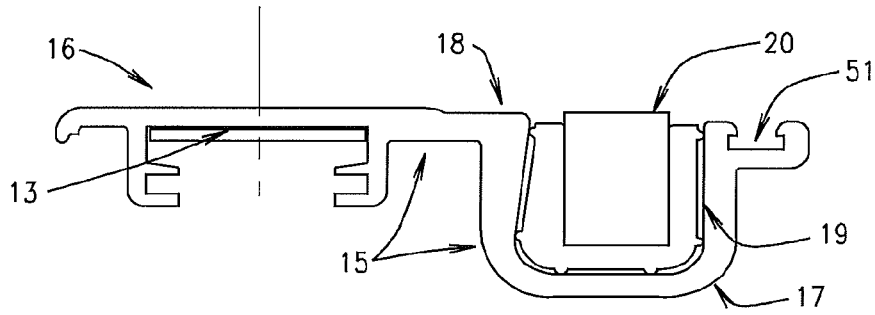
FIG. 3 is a side view of a detail (a heatable element) of the apparatus shown in FIG. 2.

In FIGS. 2 and 3 a hair apparatus in accordance with the first embodiment of the present invention is indicated with 11, and comprises typical elements of a hair straightener 1, such as, for example, a first arm 12, onto which a first heatable element 15 is applied, said first arm 12 being connected to a second arm 14, onto which a second heatable element is applied (not shown in the figures). In such a first embodiment of the invention, the heatable element 15 of the apparatus comprises a first portion 16 at one side of the first arm 12 and a second portion 17 that comprises a seat 19, of parallelepiped shape, positioned at an edge 18 of the heatable element 15, suitable for housing a treatment device 20 suitable for releasing a hair substance in operative conditions.

At the portion 16 of the heatable element 15 of the first arm 12, a heating element 13 suitable for heating, in operative conditions, the heatable element 15 and, consequently, the seat 19 forming part of it and the treatment device 20 housed in it is arranged. Optionally, said second portion 17 also comprises a housing 51 to receive a comb to be used during the hair styling operation. The housing 51 is parallelepiped shaped and is arranged beside the seat 19 for the treatment device 20.

In FIG. 4*b*, the heatable element 15 is shown for greater clarity separate from the apparatus that comprises it.

With reference to FIGS. 4*a* and 5, the heatable element 25 of a second preferred embodiment of hair apparatus in accordance with the present invention is shown. The heatable element 25 comprises a central portion 26 and two seats 29*a*,29*b* each suitable for housing a treatment device (not shown in the figures); both of the seats 29*a*,29*b* are parallelepiped shaped and are respectively placed at the opposite edges 28*a*,28*b* with respect to the central portion 26. Also in this case a heating element suitable for heating the heatable element 25 in operative conditions and, therefore, heating the two seats 29*a*,29*b* forming part of it and the treatment devices housed in them (not shown in FIGS. 4*a* and 5) is arranged at the central portion 26 of the heatable element 25.

In FIG. 4*a*, the heatable element 25 is shown for greater clarity separate from the apparatus that comprises it.

FIG. 6 shows the heatable element 25, already shown in FIGS. 4*a* and 5; the treatment device 30*a*, of cylindrical shape, is housed in the seat 29*a*, whilst the seat 29*b* is still free and suitable for housing the treatment device 30*b*, of parallelepiped shape.

In the above first and second embodiment, various possible embodiments of heatable elements 15,25, applied to the first arm 12, have been described in detail, whereas the heatable element applied to the second arm 14 has not been described in detail, since, as can be worked out from the fact that it does not appear in FIG. 2, it consists of a typical heatable element (ER), such as those of the prior art, free of seats for housing treatment devices.

However, herein below other embodiments of the hair apparatus of the present invention are taken into consideration.

For example, in fact, in accordance with a third embodiment of the present invention, in FIG. 7 a first heatable element 35*a*, applied to a first arm (not shown in the figures), and a second heatable element 35*b*, applied to a second arm (not shown in the figures), are shown, said arms being in closed position so that a hair tuft is located between the heatable elements 35*a*,35*b* to be subjected to a styling action. The heatable element 35*a* has two seats 39*a*,39*b*, both parallelepiped shaped and arranged, respectively, at the opposite edges 38*a*,38*b* with respect to the central portion 36*a*, to house treatment devices (not shown in the figures). Vice-versa, the heatable element 35*b* has a single seat 39*c*, of parallelepiped shape and arranged at the edge 38*c*.

Similarly, in accordance with a fourth embodiment of the present invention, in FIG. 8 a first heatable element 45*a*, applied to a first arm (not shown in the figures), and a second heatable element 45*b*, applied to a second arm (not shown in the figures), are shown. Each of the heatable elements 45*a*, 45*b* has two seats, 49*a*,49*b* and 49*c*,49*d* respectively, of parallelepiped shape, respectively arranged at the opposite edges 48*a*,48*b* and 48*c*,48*d*, with respect to the respective central portions 46*a*,46*b*, to house treatment devices (not shown in the figures).

Said embodiments of the apparatus of the present invention, in which many seats are foreseen to house many treatment devices, are useful when one wishes to have treatment devices that, during the same styling operation, release hair substances of a different type or also a greater amount of the same hair substance contained in more than one treatment device.

Moreover, in accordance with a fifth embodiment of the present invention, FIG. 9 shows a first heatable element 55, applied to a first arm (not shown in the figures), in which a seat 59, of parallelepiped shape, is formed, and is centrally positioned with respect to the heatable element 55, to house a treatment device 20. In this case, at each of the portions 56*a*,56*b* of the heatable element 55 a heating element 53*a*,53*b* is respectively placed to heat the heatable element 55 in operative conditions.

Similarly, in accordance with a sixth embodiment of the present invention, in FIG. 10 a first heatable element 65*a*, applied to a first arm (not shown in the figures), and a second heatable element 65*b*, applied to a second arm (not shown in the figures), are shown. Both, of the heatable elements 65*a*, 65*b* have a seat, respectively 69*a*,69*b*, of parallelepiped shape, centrally arranged with respect to the heatable elements 65*a*,65*b* themselves, to house treatment devices (not shown in the figures). At the heatable elements 65*a*,65*b* the heating elements 63*a*,63*b* and 63*c*,63*d* are respectively arranged to heat the heatable elements 65*a*,65*b* in operative conditions.

Hereafter the operation of the apparatus of the present invention in operative conditions is briefly described herein below, with reference to the first preferred embodiment represented in FIGS. 2 and 3. The arms 12,14, in closed position, hold the hair tuft to be styled between the heatable element 15 applied to the first arm 12 and a heatable element (not shown in the figures) applied to the second arm 14. The heat emitted by the heating element 13 propagates, starting from the portion 16, through the entire surface of the heatable element 15 until it reaches an edge 18 thereof, at which there is the seat 19 that houses the treatment device 20, with which the hair tuft is held in contact. Said treatment device 20, through the combined effect of the heat emitted by the heating element 13 and the contact with the hair tuft, releases the hair substance contained in it, which reaches the hair tuft held between the arms 12,14. After this, the arms 12,14 are moved apart so as to free the hair tuft and then brought together to lock another hair tuft to style hair again.

The operation of this preferred embodiment of hairstyling apparatus of the present invention is analogous to that of the other embodiments described above with reference to FIGS. 4-13, independently of the number of seats, suitable for housing the treatment devices, with which said heatable elements are provided.

However, it is worth noting that in the embodiments in which the first heatable element has a number of said seats which is different when compared to the number of said seats of the second heatable element, the two heatable elements, consequently, have a different shape, a different body mass, increased by the presence of a different number of treatment devices and, therefore, a different heat dispersion. Therefore, it is particularly advantageous to be able to adjust the temperatures of said two different heatable elements by two different control devices. For example, with reference to FIG. 7, the first heatable element 35*a* has two seats 39*a*,39*b*, whereas the second heatable element 35*b* has a single seat 39*c*. The heat dispersion in the first heatable element 35*a* shall therefore be greater than that of the second heatable element 35*b*. Therefore, the control device (not shown in the figures) connected to the first heatable element 35*a* will allow a higher temperature to be reached, to be able to compensate the greater heat dispersion. Each of said control devices that adjust the temperature of the heatable elements 35*a*,35*b* is provided with its own electronic on/off switch, for example, of the TRIAC or SCR diode type, and its own temperature detection sensor, for example, of the NTC type, so that the two temperature control devices can act autonomously.

Similarly to what has been described above with reference to FIG. 7, it is advantageous to have two distinct control devices of the temperature of the two heatable elements, each with its own switch and detection sensor, also in all of the other preferred embodiments described herein, so as to be able in any case to adjust the temperatures of the two heatable elements independently one from each other.

With reference to FIGS. 11 and 12, a further preferred embodiment of a hair apparatus in accordance with the present invention is shown, in which the first heatable element 15 is analogous to the one described in FIG. 3 but it also comprises a mechanical roller 50 applied to the outer part of the arm 12. When the arms 12,14 are in closed position, the roller 50 makes contact with the treatment device 20 housed in the seat 19 and, pressing against it, makes it even easier for the hair substance contained in said treatment device 20 to be released and, at the same time, allows better adhesion of the hair tuft on the treatment device 20.

Similarly, also with reference to the embodiments of hair apparatus described in FIGS. 5,7,9 and 13, it would be particularly advantageous to have a roller 50 (not shown in such figures). Indeed, in said embodiments, when each of the seats 29*a*,29*b*,39*a*,59,79 houses a treatment device 20, and the arms in operative conditions are in closed position, in the absence of such a roller 50 there would be no portion of a second heatable element capable of pressing against said treatment devices 20 to make it easier for the hair substance to be released. Therefore, the presence of said rollers 50 is preferable that, in cooperation with the heating action of the heating elements 13,23,33*a*,53*a*,53*b*,73*c*, allow the treatment devices 20 to release the hair substances.

A variant to the embodiments described above consists of applying a further heating element directly at one or more seats suitable for housing the treatment devices.

With reference to FIG. 13 a first heating element 73*a* suitable for heating a first heatable element 75*a* and a second heating element 73*b* suitable for heating a second heatable element 75*b* is indeed shown. Moreover, at the seat 79, wherein the treatment device 20 is housed, a further heating element 73*c* suitable for directly heating the seat 79 is positioned, so that the heat emitted by it quickly reaches the treatment device 20, reducing the heat dispersion. The temperature of the heating element 73*c* is adjusted by means of an appropriate control device. Also in this case it is particularly advantageous the presence of a roller 50 capable of making contact with the treatment device 20.

In accordance with a seventh embodiment of an apparatus of the present invention, FIG. 14 shows a first heatable element 85*a*, applied to a first arm (not shown in the figures), and a second heatable element 85*b*, applied to a second arm (not shown in the figures). The heating elements 83*a*,83*b* are respectively arranged at the heatable elements 85*a*,85*b* so as to be able to heat them, in operative conditions. Moreover, the apparatus comprises a seat 89, formed in a further heatable element 85*c* also positioned on the first arm (not shown in the figures), like the first heatable element 85*a*. The further heatable element 85*c* is arranged at the edge 88 of the first heatable element 85*a*, but it is separate from it, as can be seen from the space 90 interposed between them.

Herein below the operation of the apparatus of the present invention in operative conditions, with reference to the seventh preferred embodiment described above and represented in FIG. 14, is briefly described.

The arms (not shown in the figures), in closed position, hold the hair tuft to be styled between the heatable element 85*a* applied to the first arm and the heatable element 85*b* applied to the second arm; the length of the hair tuft is such as to also be simultaneously held between the roller 50 and the treatment device 20. The heat emitted by the heating elements 83*a* and 83*b* respectively heats the heatable elements 85*a* and 85*b* and therefore the hair tuft held between them, so as to allow the hair tuft to be heated and the consequent styling. Moreover, the heat emitted by the heating element 83*c* propagates through the heatable element 85*c* until it reaches the seat 89 that houses the treatment device 20, with which the hair tuft is held in contact thanks to the action of the roller 50. The treatment device 20, through the combined effect of the heat emitted by the heating element 83*c* and the contact with the hair tuft under the pressure of the roller 50, releases the hair substance contained in it, which reaches the hair tuft between the arms. After this, the arms are moved apart so as to free the hair tuft and then brought together to lock another hair tuft to style hair again.

In the embodiments of the hair apparatus described above in accordance with the present invention, the treatment device 20,30*a*,30*b* is made with a support material in bicomponent fibre of polyester terephthalate (PET) and of polybutylene terephthalate (PBT), in molar percentage 50/50. The treatment device, in rest conditions, is soaked with a water and/or oil based hair substance and is able to absorb up to 15 ml of hair substance by means of some cavities present on its outer surface and on the inside. The hair substance is soaked in the treatment device for the entire time in which the treatment device itself remains in rest condition, without there being any leakage of the hair substance.

Of course, the embodiments described above must be taken as mere non-limiting illustrations of some possible embodiments of the apparatus of the present invention, being clearly understood that any element inherent to the apparatus itself can be varied by the man skilled in the art in order to satisfy specific and contingent requirements, whilst still remaining within the scope of protection of what is claimed.

The invention claimed is:

1. A hairstyling apparatus comprising:

a first arm;

a second arm connected to said first arm so as to allow the apparatus to be opened and closed by moving said first and second arms respectively, apart and close, relative to one another;

at least one first heatable element positioned on said first arm and at least one second heatable element positioned on said second arm;

one or more seats, said seats housing at least one treatment device containing a hair substance in operative conditions;

said apparatus comprising a presser suitable for making contact with the treatment device; and said presser being at least one of a roller or a pad; and wherein said apparatus also comprises at least one of a first heating element and a second heating element and wherein said first heating element is suitable for heating said first heatable element and second heating element is suitable for heating said second heatable element.

2. The apparatus according to claim 1, wherein said presser is equipped with springs or elastic.

3. The apparatus according to claim 2, wherein said springs or elastic are adjustable through a device for adjusting the thrusting force.

4. The apparatus according to claim 1, wherein at least one of said seats is formed in at least one of said first heatable element and said second heatable element.

5. The apparatus according to claim 4, wherein at least one of said seats is positioned at an edge of at least one of said first and said second heatable elements.

6. The apparatus according to claim 5, wherein said edges are arranged outside of said arms.

7. The apparatus according to claim 4, wherein at least two of said seats are positioned at opposite edges of at least one of said first and second heatable elements.

8. The apparatus according to claim 4, wherein at least one of said seats is positioned at an edge of said first heatable element and at least another of said seats is positioned at an edge of said second heatable element.

9. The apparatus according to claim 4, wherein at least two of said seats are positioned at opposite edges of said first heatable element and at least another two of said seats are positioned at opposite edges of said second heatable element.

10. The apparatus according to claim 4, wherein at least one of said seats is centrally positioned with respect to at least one of said heatable elements.

11. The apparatus according to claim 4, wherein at least one of said seats is centrally positioned with respect to said first heatable element and at least another of said seats is centrally positioned with respect to said second heatable element.

12. The apparatus according to claim 1, wherein said apparatus comprises a heating element arranged at said one or more seats.

13. The apparatus according to claim 1, wherein at least one of said seats is formed in at least one further heatable element, said further heatable element being positioned on at least one of said arms and being separate from said first heatable element and from said second heatable element.

14. The apparatus according to claim 13, wherein said apparatus comprises at least one further heating element suitable for heating said further heatable element.

15. The apparatus according to claim 13, wherein said at least one further heatable element is arranged at at least one edge of said first heatable element and of said second heatable element.

16. The apparatus according to claim 1, wherein said treatment device comprises a support material soaked with said hair substance.

17. The apparatus according to claim 16, wherein said support material is an expanded or sintered plastic material, sintered metallic material or cellulose derivate, polymeric derivate from polyacrylic and from polyesters, from teraphthalates, from polyethylenes, silicon and derivates, fabrics, unwoven fabrics, or mixtures thereof.

18. The apparatus according to claim 16, wherein said support material is polytetrafluoroethylene or a bicomponent fibre of polyolefin.

19. The apparatus according to claim 18, wherein said bicomponent fibre comprises a bicomponent fibre of polyester terephthalate (PET) and of polybutylene terephthalate (PBT).

20. The apparatus according to claim 19, wherein said bicomponent fibre of PET and PBT contains amounts of PET and of PBT, respectively, within a range of 20%-80% and a range of 80-20%, in molar percentage with respect to a total number of moles of the bicomponent fibre.

21. The apparatus according to claim 1, wherein the hair substance is water-based, oil based or a mixed water/oil based substance.

22. The apparatus according to claim 1 wherein said treatment device is in single use packages.

23. The apparatus according to claim 1, wherein said treatment device is parallelepiped shaped with a rectangular, square or trapezoidal section, cylindrical shaped with a circular section, said circular section being perforated in the center or an elliptical section.

24. The apparatus according to claim 1, wherein said apparatus is a hair straightener.

* * * * *